US009534813B2

(12) United States Patent
Xu

(10) Patent No.: US 9,534,813 B2
(45) Date of Patent: Jan. 3, 2017

(54) CRYOGENIC REFRIGERATOR

(75) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 517 days.

(21) Appl. No.: 13/611,400

(22) Filed: Sep. 12, 2012

(65) Prior Publication Data

US 2013/0074522 A1 Mar. 28, 2013

(30) Foreign Application Priority Data

Sep. 26, 2011 (JP) ..... 2011-209937

(51) Int. Cl.
*F25B 9/14* (2006.01)
*F01B 9/02* (2006.01)

(52) U.S. Cl.
CPC ..... *F25B 9/14* (2013.01); *F01B 9/023* (2013.01); *F01B 9/026* (2013.01); *F25B 2309/1406* (2013.01)

(58) Field of Classification Search
CPC ..... F25B 9/14; F25B 19/14; F25B 2309/003; F25B 2309/006; F01B 9/023; F01B 9/026
USPC ..... 62/51.1; 74/50
See application file for complete search history.

(56) References Cited

U.S. PATENT DOCUMENTS 4,791,898 A * 12/1988 Jayne ..... F01B 9/023 123/197.4
5,156,121 A * 10/1992 Routery ..... F01B 9/02 123/197.3
5,361,588 A 11/1994 Asami et al.
5,398,512 A * 3/1995 Inaguchi ..... F25B 9/14 60/520
2012/0019005 A1* 1/2012 Wilkins ..... F01B 9/023 290/1 A

FOREIGN PATENT DOCUMENTS

JP 06-101917 4/1994
JP 2617681 6/1997
JP 10-122682 5/1998

* cited by examiner

*Primary Examiner* — Frantz Jules
*Assistant Examiner* — Brian King
(74) *Attorney, Agent, or Firm* — IPUSA, PLLC

(57) ABSTRACT

A cryogenic refrigerator includes a Scotch yoke mechanism including a Scotch yoke and a bearing movably engaged with the Scotch yoke, and a displacer caused to reciprocate in a cylinder by the Scotch yoke mechanism, so that a refrigerant gas inside an expansion space formed in the cylinder is expanded by the reciprocation of the displacer to generate cold temperatures. The Scotch yoke includes a concave part at a position corresponding to a top dead center of the displacer.

10 Claims, 8 Drawing Sheets

| | FIRST-STAGE TEMPERATURE (K)44W | SECOND-STAGE TEMPERATURE (K)1.0W |
|---|---|---|
| COMPARATIVE EXAMPLE | 46.2 | 4.26 |
| EMBODIMENT | 45.1 | 4.19 |

CRYOGENIC REFRIGERATOR

CROSS-REFERENCE TO RELATED APPLICATION

This application is based upon and claims the benefit of priority of the prior Japanese Patent Application No. 2011-209937, filed on Sep. 26, 2011, the entire contents of which are incorporated herein by reference.

BACKGROUND OF THE INVENTION

1. Field of the Invention

The present invention relates generally to cryogenic refrigerators, and more particularly to a cryogenic refrigerator including a displacer.

2. Description of the Related Art

Gifford-McMahon (GM) refrigerators have been known as cryogenic refrigerators that include a displacer. In the GM refrigerator, the displacer is caused to reciprocate in a cylinder by a drive unit.

In such an environment, an expansion space is formed between the cylinder and the displacer. The displacer reciprocates in the cylinder to expand a high-pressure refrigerant gas fed into the expansion space, thereby producing cryogenic temperatures.

In general, in this type of GM refrigerator, during one cycle of reciprocation in a cylinder, the speed at which the displacer moves from the top dead center to the bottom dead center is equal to the speed at which the displacer moves from the bottom dead center to the top bottom center. That is, conventionally, during one cycle of its reciprocation, the displacer is designed to move in a cylinder so that when plotted, its movement is along a substantial sine wave. (See, for example, Japanese Patent No. 2617681.)

SUMMARY OF THE INVENTION

According to an aspect of the present invention, a cryogenic refrigerator includes a Scotch yoke mechanism including a Scotch yoke and a bearing movably engaged with the Scotch yoke; and a displacer caused to reciprocate in a cylinder by the Scotch yoke mechanism, so that a refrigerant gas inside an expansion space formed in the cylinder is expanded by the reciprocation of the displacer to generate cold temperatures, wherein the Scotch yoke includes a concave part at a position corresponding to a top dead center of the displacer.

The object and advantages of the present invention will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In general, an expansion process for producing cold temperatures by expanding a refrigerant gas in an expansion chamber is performed when the displacer is at or near a top dead center position.

According to the cryogenic refrigerator disclosed in Japanese Patent No. 2617681, however, the displacer momentarily stops at the top dead center, but immediately starts to move toward the bottom dead center. This makes the process for expanding the refrigerant gas insufficient, thus causing the problem of a decrease in cooling efficiency.

According to an aspect of the present invention, a cryogenic refrigerator improved in cooling efficiency is provided.

According to an embodiment of the present invention, a cryogenic refrigerator is allowed to have a longer process for expanding a refrigerant gas to be improved in cooling efficiency.

A description is give below, with reference to the accompanying drawings, of an embodiment of the present invention.

Figure 1:
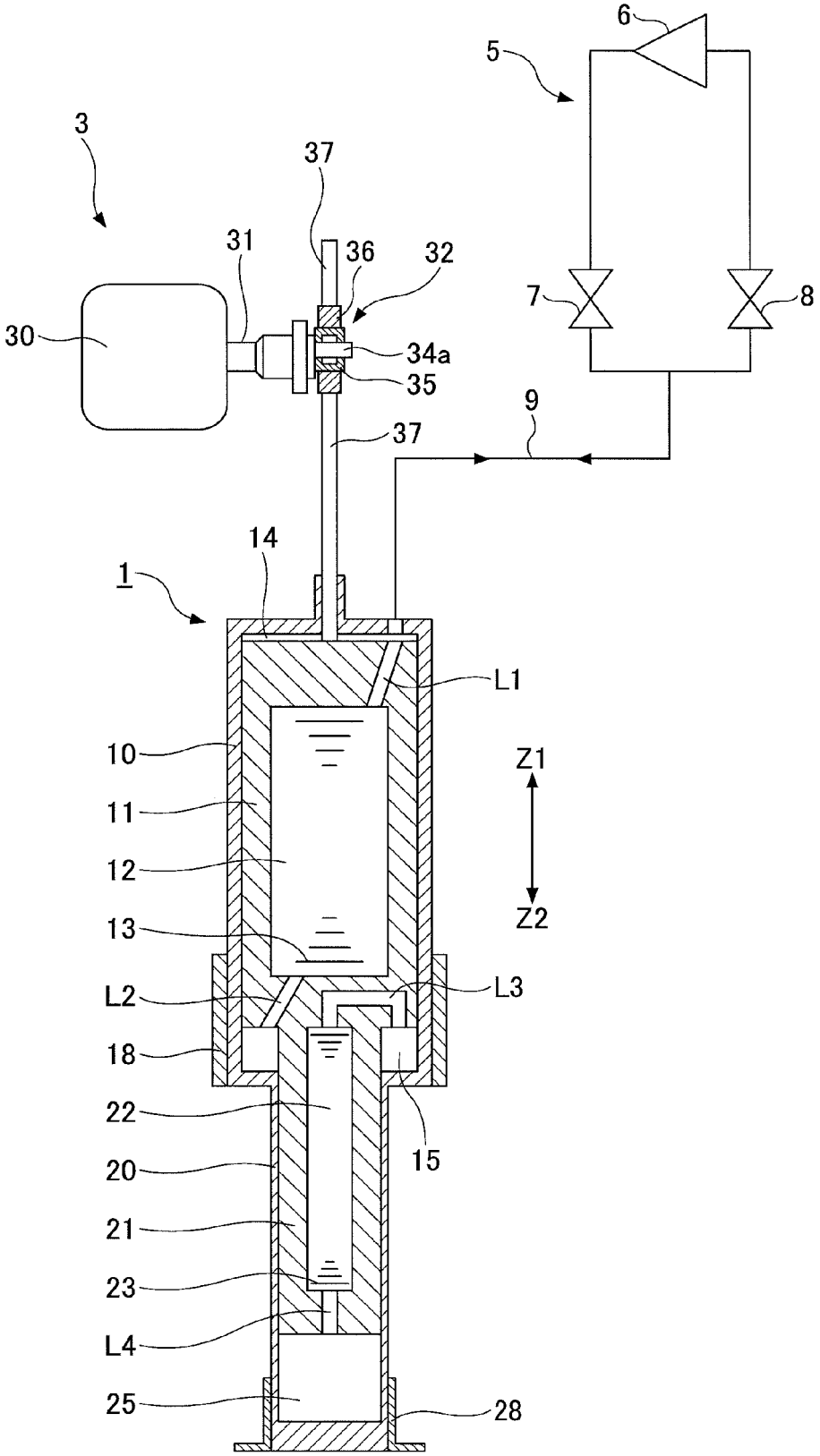
FIG. 1 is a schematic diagram illustrating a configuration of a GM refrigerator according to an embodiment of the present invention.

FIG. 1 is a diagram illustrating a cryogenic refrigerator according to the embodiment of the present invention. The following description uses a cryogenic refrigerator using the Gifford-McMahon cycle (hereinafter referred to as "GM refrigerator") as an example cryogenic refrigerator. However, the application of embodiments of the present invention is not limited to GM refrigerators, and embodiments of the present invention may also be applied to various kinds of cryogenic refrigerators using a displacer, such as Solvay cycle refrigerators and Stirling refrigerators.

According to this embodiment, a two-stage GM refrigerator 1 includes a first-stage cylinder 10 and a second-stage cylinder 20. The first-stage cylinder 10 and the second-stage cylinder 20 are formed of stainless steel, which has low thermal conductivity. Further, the high-temperature end of the second-stage cylinder 20 is connected to the low-temperature end of the first-stage cylinder 10.

The diameter of the second-stage cylinder 20 is smaller than the diameter of the first-stage cylinder 10. A first-stage displacer 11 and a second-stage displacer 21 are inserted into the first-stage cylinder 10 and the second-stage cylinder 20, respectively. The first-stage displacer 11 and the second-stage displacer 21 are interconnected to be caused to reciprocate in the axial directions of the first-stage and second-stage cylinders 10 and 20 (the directions indicated by arrows Z1 and Z2 in FIG. 1) by a drive mechanism 3.

Further, a regenerator 12 and a regenerator 22 are provided in the first-stage displacer 11 and the second-stage displacer 21, respectively. The regenerators 12 and 22 are filled with regenerator materials 13 and 23, respectively. Further, a cavity 14 is formed inside the first-stage cylinder 10 at its high-temperature end. A first-stage expansion chamber 15 is formed inside the first-stage cylinder 10 at its low-temperature end. Further, a second-stage expansion chamber 25 is formed inside the second-stage cylinder 20 at its low-temperature end.

Multiple gas passages L1, L2, L3 and L4 through which a refrigerant gas (helium gas) flows are provided in the first-stage displacer 11 and the second-stage displacer 21. The gas passage L1 connects the cavity 14 and the regenerator 12. The gas passage L2 connects the regenerator 12 and the first-stage expansion chamber 15. The gas passage L3 connects the first-stage expansion chamber 15 and the regenerator 22. The gas passage L4 connects the regenerator 22 and the second-stage expansion chamber 25.

The cavity 14 of the first-stage cylinder on its high-temperature end side is connected to a gas feed system 5. The gas feed system 5 includes a gas compressor 6, an intake valve 7, an exhaust valve 8, and a gas passage 9.

The intake valve 7 is connected to the outlet side of the gas compressor 6. The exhaust valve 8 is connected to the inlet side of the gas compressor 6. When the intake valve 7 is opened and the exhaust valve 8 is closed, a refrigerant gas is fed into the cavity 14 from the gas compressor 6 through the intake valve 7 and the gas passage 9. When the intake valve 7 is closed and the exhaust valve 8 is opened, a refrigerant gas in the cavity 14 is collected into the gas compressor 6 through the gas passage 9 and the exhaust valve 8.

Figure 2:
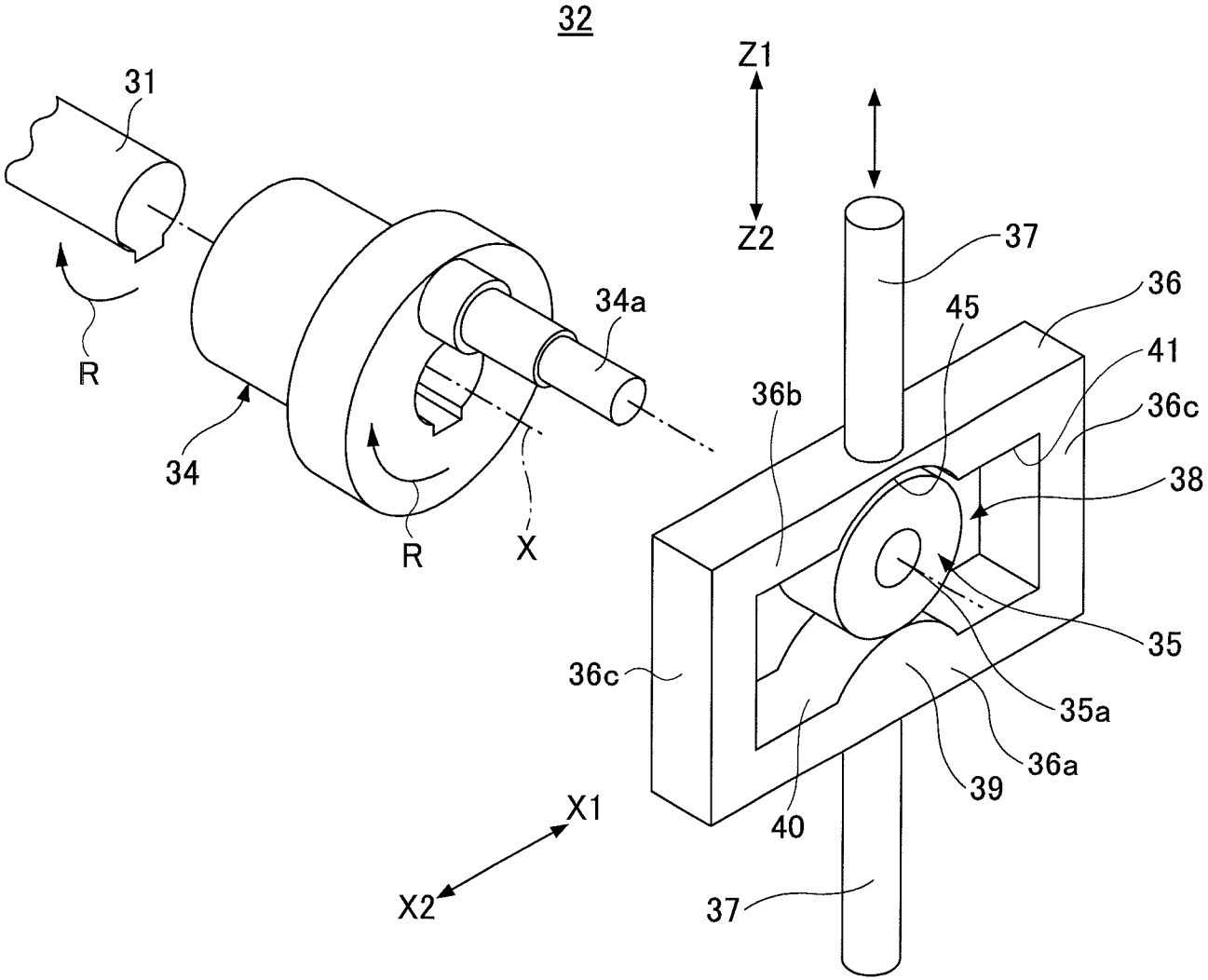
FIG. 2 is an enlarged exploded perspective view of a Scotch yoke mechanism of the GM refrigerator according to the embodiment of the present invention.

The drive mechanism 3 causes the first-stage and second-stage displacers 11 and 21 to reciprocate in the first-stage and second-stage cylinders 10 and 20, respectively. The drive mechanism 3 includes a motor 30 and a Scotch yoke mechanism 32. FIG. 2 is an enlarged view of the Scotch yoke mechanism 32. The Scotch yoke mechanism 32 includes a crank member 34 and a Scotch yoke 36.

The crank member 34 is fixed to a motor shaft 31, which is the rotating shaft of the motor 30. The crank member 34 has a crank pin 34*a* at a position eccentric to a position at which the motor shaft 31 is attached to the crank member 34. Accordingly, the crank member 34 is attached to the motor shaft 31 with the motor shaft 31 and the crank pin 34*a* being eccentric to each other.

A slide groove (opening) 38 is so formed in the Scotch yoke 36 as to extend in directions perpendicular to the moving directions of the displacers 11 and 21 (that is, the slide groove 38 is elongated in directions indicated by arrows X1 and X2 in FIG. 2). Accordingly, the Scotch yoke 36 has a frame shape.

A roller bearing 35 engages with the slide groove 38 formed in the Scotch yoke 36. The roller bearing 35 is allowed to roll in the X1 and the X2 direction in the slide groove 38. For convenience of description, a detailed description of a configuration of the Scotch yoke 36 and a configuration of the slide groove 38 is given below.

A crank pin engagement hole 35*a* to engage with the crank pin 34*a* is formed in the center of the roller bearing 35. Accordingly, when the motor shaft 31 rotates in a direction indicated by R in FIG. 2 (a clockwise direction when viewed from the Scotch yoke 36) with the crank pin 34*a* engaging with the roller bearing 35, the crank pin 34*a* rotates in such a manner as to draw a circle, so that the Scotch yoke 36 reciprocates in the Z1 and the Z2 direction in FIG. 2. In this case, the roller bearing 35 reciprocates in the X1 and the X2 direction in the slide groove 38.

The Scotch yoke 36 is provided with a drive arm 37 that extends upward (in the Z1 direction) and downward (in the Z2 direction). A portion of the drive arm 37 that extends downward from the Scotch yoke 36 is connected to the first-stage displacer 11 as illustrated in FIG. 1. Therefore, when the Scotch yoke 36 is caused to reciprocate in the Z1 and the Z2 direction by the Scotch yoke mechanism 32 as described above, the drive arm 37 moves upward and downward, so that the first-stage and second-stage displacers 11 and 21 reciprocate in the first-stage and second-stage cylinders 10 and 20, respectively.

The intake valve 7 and the exhaust valve 8 are provided as a rotary valve (not graphically illustrated) driven by the motor 30. The rotary valve is caused to rotate so that the intake valve 7 and the exhaust valve 8 are opened and closed with a predetermined phase difference relative to the reciprocation of the first-stage and second-stage displacers 11 and 21. As a result, a refrigerant gas expands in the first-stage expansion chamber 15 and the second-stage expansion chamber 25 with predetermined timing, so that cold temperatures are produced in the first-stage expansion chamber 15 and the second-stage expansion chamber 25.

The intake valve 7 and the exhaust valve 8 may be formed of solenoid valves, and the intake valve 7 and the exhaust valve 8 may be opened and closed with a predetermined phase difference relative to the reciprocation of the first-stage and second-stage displacers 11 and 21 by electrically controlling the intake valve 7 and the exhaust valve 8 using a controller.

Next, a description is given of an operation of the GM refrigerator 1 of the above-described configuration.

The controller opens the intake valve 7 of the gas feed system 5 immediately before the first-stage and second-stage displacers 11 and 21 reach the bottom dead center (BDC). For example, according to this embodiment, the intake 7 is opened when the first-stage and second-stage displacers 11 and 21 reach a position 30° (in crank angle) before (short of) the bottom dead center. At this point, the exhaust valve 8 remains closed.

This allows a high-pressure refrigerant gas generated in the gas compressor 6 to flow into the regenerator 12 formed in the first-stage displacer 11 through the gas passage 9 and the gas passage L1. The refrigerant gas that has flown into the regenerator 12 travels while being cooled by the regenerator material 13 in the regenerator 12, so as to flow into the first-stage expansion chamber 15 through the gas passage L2.

The refrigerant gas that has flown into the first-stage expansion chamber 15 flows into the regenerator 22 formed in the second-stage displacer 21 through the gas passage L3. The refrigerant gas that has flown into the regenerator 12 travels while being cooled by the regenerator material 23 in the regenerator 22, so as to flow into the second-stage expansion chamber 25 through the gas passage L4.

After the intake valve 7 is opened, the first-stage and second-stage displacers 11 and 21 are driven by the drive mechanism 3 to reach the bottom dead center to minimize the volumes of the first-stage and second-stage expansion chambers 15 and 25, when the downward movements of the first-stage and second-stage displacers 11 and 21 (in the Z2 direction in FIG. 1) momentarily stop (that is, the movement speed of the first-stage and second-stage displacers 11 and 21 becomes zero).

Thereafter, the first-stage and second-stage displacers 11 and 21 start to move upward (in the Z1 direction in FIG. 1). With this movement, the high-pressure refrigerant gas fed from the gas compressor 6 is fed (taken in) into the second-stage expansion chamber 25 and the first-stage expansion chamber 15 through the above-described route. When the first-stage and second-stage displacers 11 and 21 reach their respective positions corresponding to a crank angle of 121°, the intake valve 7 is closed, so that the feeding of the refrigerant gas from the gas feed system 5 to the GM refrigerator 1 is stopped.

After the intake valve 7 is closed, when the first-stage and second-stage displacers 11 and 21 move upward to reach their respective positions corresponding to a crank angle of 170°, the controller drives the gas feed system 5 to open the exhaust valve 8. At this point, the intake valve 7 remains closed. As a result, the refrigerant gas in the first-stage and second-stage expansion chambers 15 and 25 expands, so that cold temperatures are produced in the first-stage and second-stage expansion chambers 15 and 25.

After the exhaust valve 8 is opened, the first-stage and second-stage displacers 11 and 21 are driven by the drive mechanism 3 to reach the top dead center (TDC) to stop moving upward (in the Z1 direction in FIG. 1) (that is, the movement speed of the first-stage and second-stage displacers 11 and 21 becomes zero). Thereafter, the first-stage and second-stage displacers 11 and 21 start to move downward (in the Z2 direction in FIG. 1). With this, the refrigerant gas that has expanded in the second-stage expansion chamber 25 flows into the regenerator 22 through the gas passage L4 to pass through the regenerator 22 while cooling the regenerator material 23 in the regenerator 22, so as to flow into the first-stage expansion chamber 15 through the gas passage L3.

The refrigerant gas that has flown into the first-stage expansion chamber 15, along with the refrigerant gas that has expanded in the first-stage expansion chamber 15, flows into the regenerator 12 through the gas passage L2. The refrigerant gas that has flown into the regenerator 12 travels while cooling the regenerator material 13 to be collected into the gas compressor 6 of the gas feed system 5 through the gas passage L1, the gas passage 9, and the exhaust valve 8. When the first-stage and second-stage displacers 11 and 21 reach their respective positions corresponding to a crank angle of 340°, the exhaust valve 8 is closed, so that the collection (taking-in) of the refrigerant gas from the GM refrigerator 1 into the gas feed system 5 stops.

By repeatedly executing the above-described cycle, it is possible to produce cold temperatures of approximately 20 K to approximately 50 K and to produce cryogenic temperatures lower than or equal to approximately 4 K to approximately 10 K.

Figure 3A:
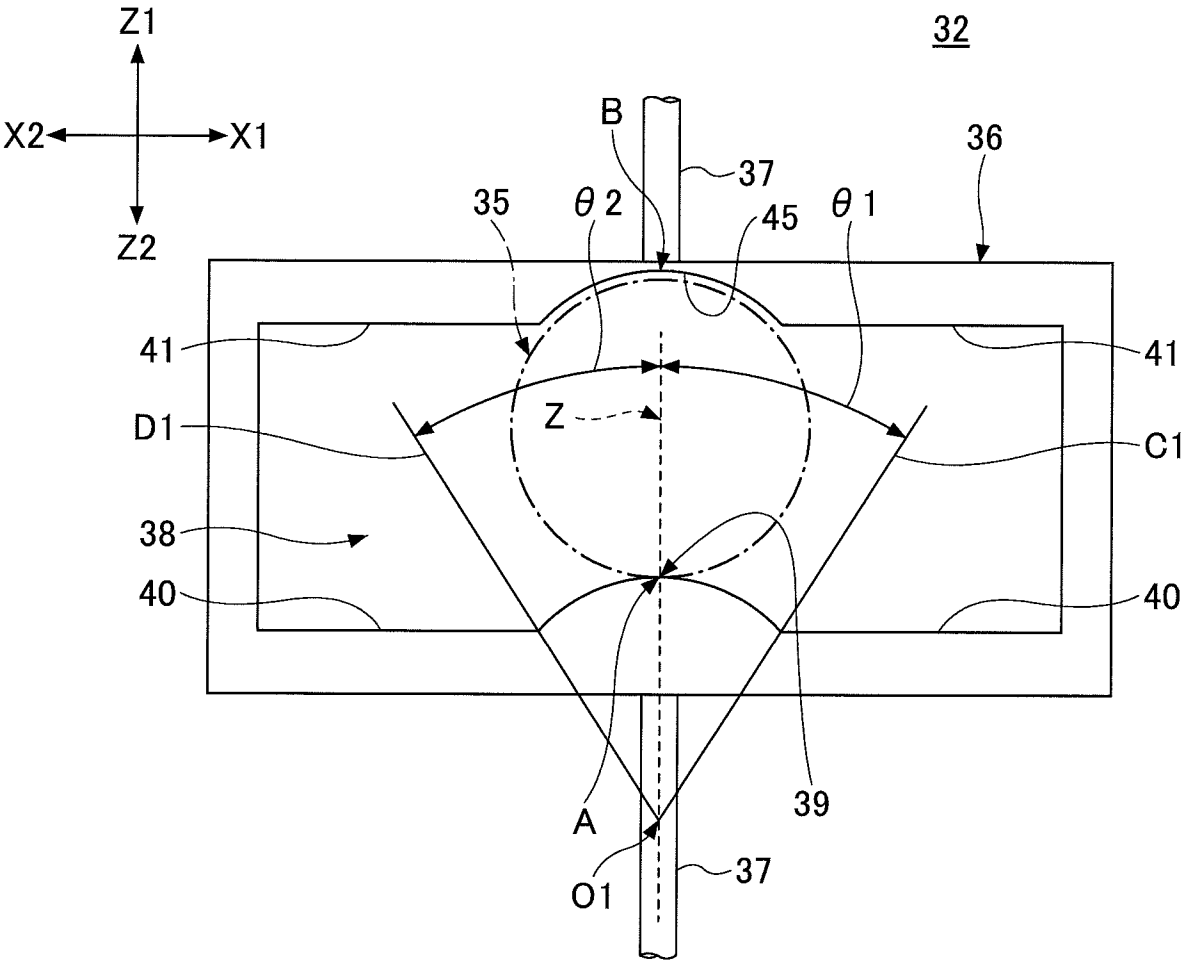
FIGS. 3A and 3B are enlarged views of a frame-shaped Scotch yoke of the Scotch yoke mechanism according to the embodiment of the present invention.
Figure 3B:
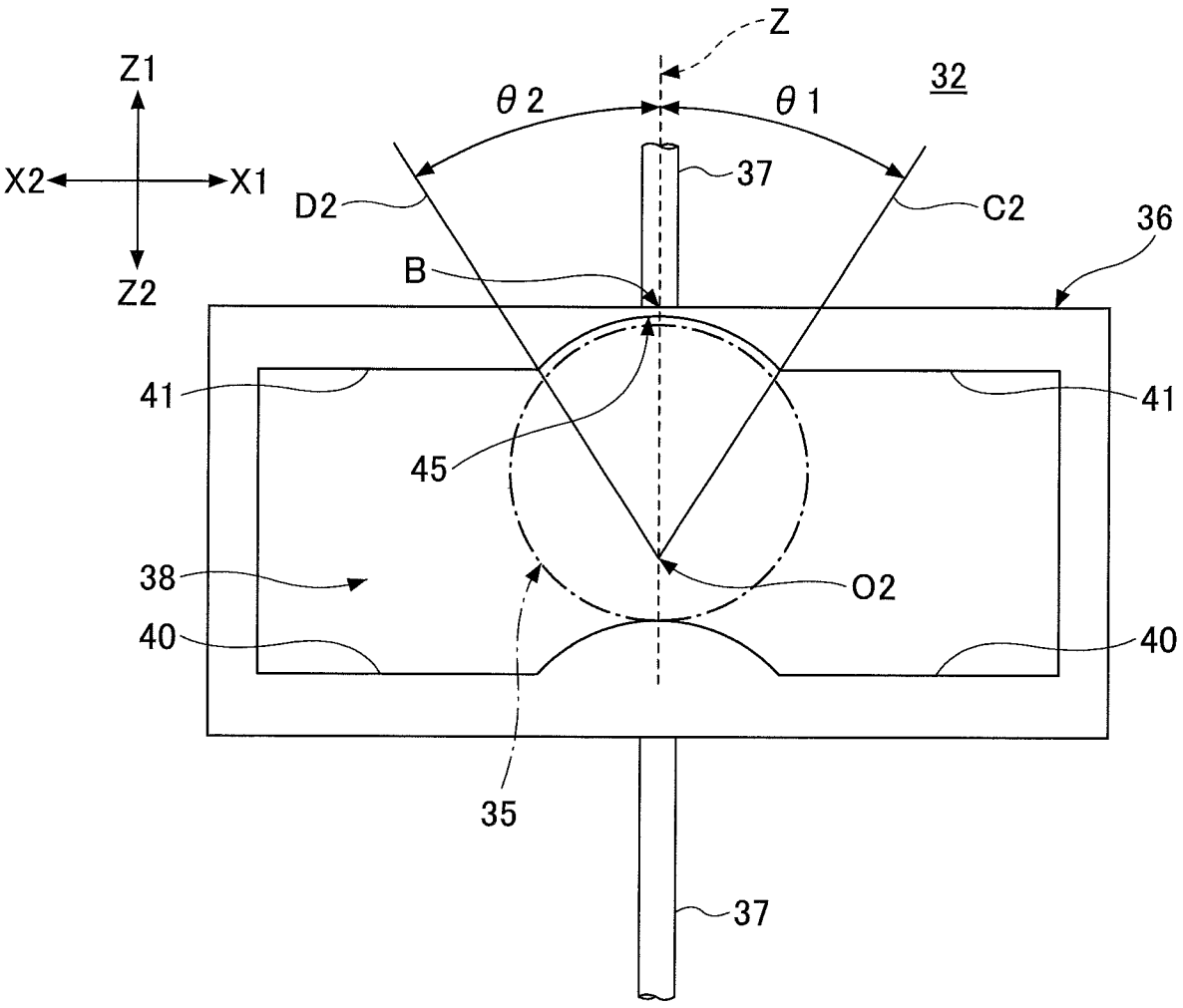

Here, a description is given, with reference to FIG. 2 and FIGS. 3A and 3B, of a configuration and a function of the Scotch yoke 36 of the drive mechanism 3.

FIGS. 3A and 3B are front elevational views of the Scotch yoke 36. As described above, the slide groove 38 elongated in the X1 and the X2 direction is formed in the Scotch yoke 36. The conventional Scotch yoke commonly has a slide groove having an oblong rectangular shape.

In contrast, according to this embodiment, the Scotch yoke 36 (the slide groove 38) has a convex (projecting) part 39 formed at a position corresponding to the bottom dead center of the first-stage and second-stage displacers 11 and 21 (indicated by arrow A in FIG. 3A and hereinafter referred to as "bottom dead center (BDC) corresponding position A"). Further, the Scotch yoke 36 (the slide groove 38) has a concave (depressed) part 45 formed at a position (region) corresponding to the top dead center of the first-stage and second-stage displacers 11 and 21. Hereinafter, the center of this position corresponding to the top dead center is referred to as "top dead center (TDC) center position B" (indicated by arrow B in FIGS. 3A and 3B).

Referring to FIG. 2, the Scotch yoke 36 includes a lower horizontal frame part 36*a* elongated in the X1 and the X2 direction, an upper horizontal frame part 36*b* elongated in the X1 and the X2 direction, and vertical frame parts 36*c* elongated in the Z1 and the Z2 direction. The lower horizontal frame part 36*a* includes a lower horizontal (surface) part 40. The upper horizontal frame part 36*b* includes an upper horizontal (surface) part 41. The lower horizontal part 40 defines a lower side of the slide groove 38. The upper horizontal part 41 defines an upper side of the slide groove 38. The lower horizontal frame part 36*a* includes a projecting portion that projects upward (in the Z1 direction) in the substantial center of the lower horizontal frame part 36*a* to form the convex part 39. That is, the lower horizontal part 40 is projecting upward in the substantial center of the lower horizontal frame part 36*a*. The upper horizontal frame part 36*b* includes a portion that is depressed upward (in the Z1 direction) in the substantial center of the upper horizontal frame part 36*b* to form the concave part 45. That is, the upper horizontal part 41 is depressed upward in the substantial center of the upper horizontal frame part 36*b*.

First, a description is given, with reference to FIG. 3A, of the convex part 39. In FIG. 3A, an imaginary line extending vertically (in the Z1 and the Z2 direction) to pass through the BDC corresponding position A and the TDC center position B is indicated by a broken line. In the following description, this imaginary line is referred to as "center line Z." The drive arm 37 is aligned with the center line Z.

The convex part 39 has a shape projecting in the Z1 direction from the lower horizontal part 40. Referring to FIG. 3A, the convex part 39 is defined by an arc of a circle having a center at a position indicated by arrow O1. This position is hereinafter referred to as "first center point O1." According to this embodiment, the convex part 39 has a shape symmetrical with respect to the center line Z in the X1 and the X2 direction in FIG. 3A.

Accordingly, letting a line connecting an end of the convex part 39 in the X1 direction and the first center point O1 and a line connecting an end of the convex part 39 in the X2 direction and the first center point O1 be a line C1 and a line D1, respectively, an angle θ1 formed by the line C1 and the center line Z is equal to an angle θ2 formed by the line D1 and the center line Z (θ1=θ2).

Next, a description is given, with reference to FIG. 3B, of the concave part 45. The concave part 45 has a shape depressed in the Z1 direction relative to the upper horizontal part 41. The concave part 45 is defined by an arc of a circle having a center at a position indicated by arrow O2 in FIG. 3B. This position is hereinafter referred to as "second center point O2." According to this embodiment, the concave part 45 also has a shape symmetrical with respect to the center line Z in the X1 and the X2 direction in FIG. 3B.

Accordingly, letting a line connecting an end of the concave part 45 in the X1 direction and the second center point O2 and a line connecting an end of the concave part 45 in the X2 direction and the second center point O2 be a line C2 and a line D2, respectively, the angle θ1 formed by the line C2 and the center line Z is equal to the angle θ2 formed by the line D2 and the center line Z (θ1=θ2).

According to this embodiment, the above-described angles θ1 and θ2 are determined to be equal to 30° (θ1=θ2=30°). However, the angles θ1 and θ2 are not limited to this, and may be determined within a range of, for example, 20° to 40° (20°≤θ1=θ2≤40°).

The angles θ1 and θ2 that define the area of formation of the convex part 39 and the concave part 45 do not always have to be equal as described above, and may be different (θ1≠θ2).

Further, according to this embodiment, the arc-shaped convex part 39 is directly connected to (continuous with) the lower horizontal part 40. Alternatively, a smooth connecting part (for example, a linear part) may be interposed between the arc-shaped convex part 39 and the lower horizontal part 40 for a smooth movement of the roller bearing 35.

Further, according to this embodiment, the arc-shaped concave part 45 is directly connected to (continuous with) the upper horizontal part 41. Alternatively, a smooth connecting part (for example, a linear part) may be interposed between the arc-shaped concave part 45 and the upper horizontal part 41 for a smooth movement of the roller bearing 35.

Next, a description is given, with reference to FIG. 4 and FIGS. 5A through 5H, of operations of the first-stage and second-stage displacers 11 and 21 using the Scotch yoke mechanism 32 including the Scotch yoke 36 of the above-described configuration.

Figure 4:
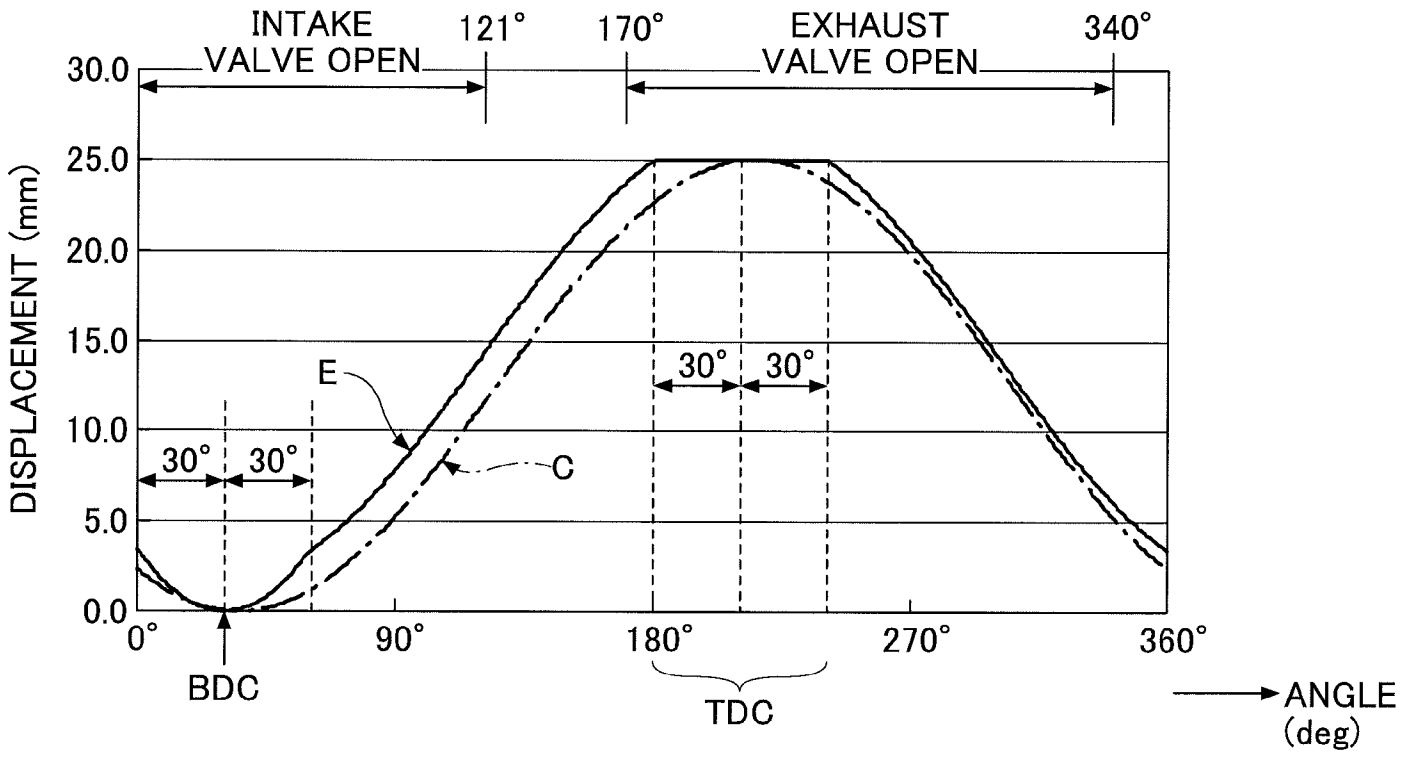
FIG. 4 is a graph illustrating a motion curve diagram of a displacer in the GM refrigerator according to the embodiment of the present invention.

FIG. 4 is a graph illustrating motion curves of the second-stage displacer 21. FIGS. 5A through 5H are diagrams illustrating movements of the roller bearing 35 within the slide groove 38.

In FIG. 4, the horizontal axis represents the rotation angle (crank angle) of the crank member 34, and the vertical axis represents the displacement (the amount of movement) of the second-stage displacer 21. Further, the characteristics of the GM refrigerator 1 according to this embodiment are illustrated by a solid line (indicated by arrow E in FIG. 4), and the characteristics of the conventional GM refrigerator without the convex part 39 and the concave part 45 are illustrated by a one-dot chain line (indicated by arrow C in FIG. 4). Further, in FIGS. 5A through 5H, for convenience of graphical representation, a gap between the roller bearing 35 and the slide groove 38 is illustrated to be larger than actually is.

Figure 5A:
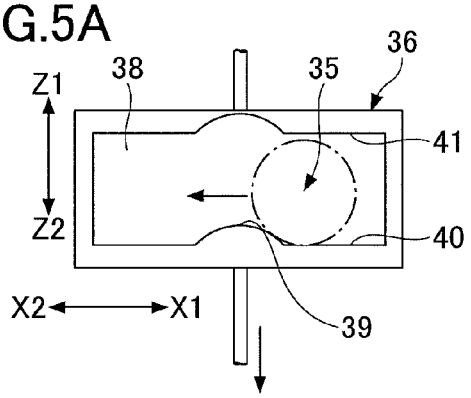
FIGS. 5A through 5H are diagrams for illustrating an operation of the Scotch yoke mechanism of the GM refrigerator according to the embodiment of the present invention.

According to the Scotch yoke mechanism 32 of this embodiment, a crank angle that is 30° less than a crank angle corresponding to the bottom dead center in the rotation direction R (FIG. 2) is determined as a crank angle of 0° (see FIG. 4). Therefore, when the crank angle is 0°, the roller bearing 35 is positioned at the boundary between the lower horizontal part 40 and the convex part 39 in the slide groove 38 as illustrated in FIG. 5A.

When the crank member 34 rotates 30° from this state, the roller bearing 35 is caused to move and urge the Scotch yoke 36 downward (in the Z2 direction). With this movement, the roller bearing 35 moves inside the slide groove 38 in the X2 direction.

Thus, the roller bearing 35 moves inside the slide groove 38 in the X2 direction while engaging with (contacting) the convex part 39, so that the roller bearing 35 moves onto the convex part 39.

The crank pin 34*a* to which the roller bearing 35 is attached is at a position eccentric to the center of the crank member 34. Therefore, with the movement of the roller bearing 35, the Scotch yoke 36 moves in the Z2 direction. Further, the first-stage and second-stage displacers 11 and 21 are connected to the Scotch yoke 36 via the drive arm 37. Therefore, with the movement of the Scotch yoke 36, the first-stage and second-stage displacers 11 and 21 as well move in the Z2 direction.

Here, attention is drawn to the movement speed of the Scotch yoke 36 (which is equivalent to the movement speed of the first-stage and second-stage displacers 11 and 21).

The convex part 39 projects in the Z1 direction relative to the lower horizontal part 40. Accordingly, the amount of movement of the Scotch yoke 36 per unit time is greater when the roller bearing 35 is engaged with the convex part 39 than when the roller bearing 35 is engaged with the lower horizontal part 40.

Figure 5B:
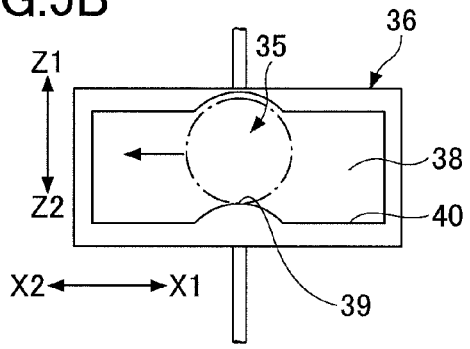

FIG. 5B illustrates a state at the time when the crank angle is 30°. According to this embodiment, the first-stage and second-stage displacers 11 and 21 reach the bottom dead center when the crank angle is 30°. Therefore, the roller bearing 35 is positioned at the top (center) of the convex part 39 at the bottom dead center.

When the roller bearing 35 passes by the position corresponding to the bottom dead center of the first-stage and second-stage displacers 11 and 21 with the rotation of the crank member 34, the moving direction of the Scotch yoke is reversed. That is, the Scotch yoke 36 starts to move upward (in the Z1 direction) when the roller bearing 35 goes past the position corresponding to the bottom dead center.

Figure 5C:
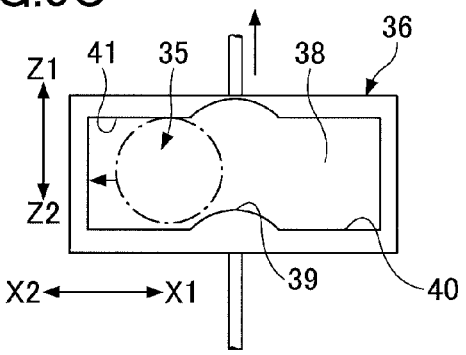

The roller bearing 35 remains engaged (in contact) with the convex part 39 during the period between the bottom dead center and a crank angle 30° past the bottom dead center. For example, the roller bearing 35 moves while remaining engaged with a portion of the convex part 39 on the X2 direction side of the center line Z, and becomes apart (disengaged) from the convex part 39. This state is illustrated in FIG. 5C.

Figure 5D:
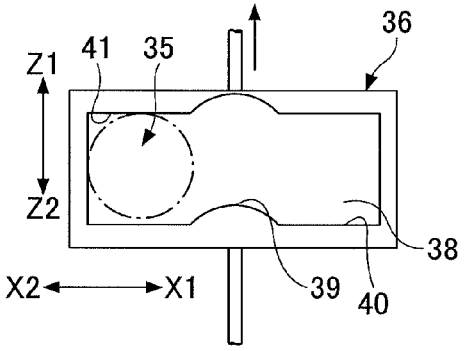

The crank member 34 further rotates, so that the roller bearing 35 moves inside the slide groove 38 in the X2 direction while engaging with the upper horizontal part 41 as illustrated in FIG. 5D. With this movement of the roller bearing 35, the first-stage and second-stage displacers 11 and 21 move upward (in the Z1 direction).

Next, a description is given of movements of the roller bearing 35 at the time when the roller bearing 35 is engaged with the concave part 45.

Figure 5E:
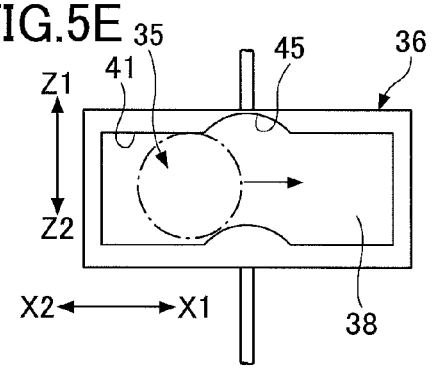
Figure 5F:
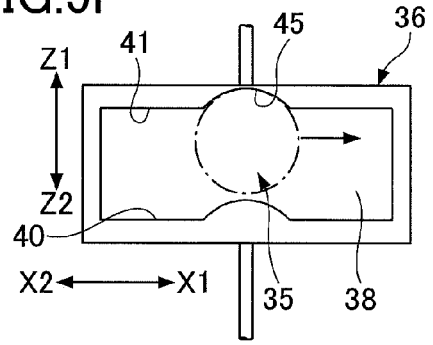
Figure 5G:
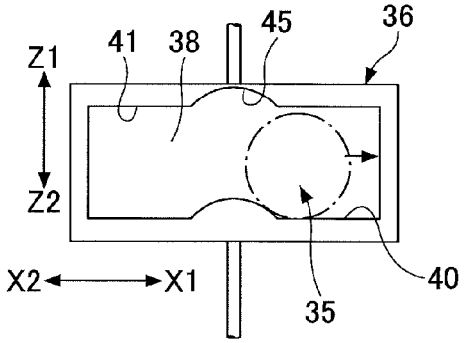

FIGS. 5E through 5G are diagrams illustrating movements of the roller bearing 35 at the time when the roller bearing 35 is engaged with the concave part 45. The concave part 45 has a shape depressed relative to the upper horizontal part 41. The concave part 45 is so formed as to prevent the Scotch yoke 36 (the first-stage and second-stage displacers 11 and 21) from moving in the Z1 or Z2 direction while the roller bearing 35 is engaged with the concave part 45.

Further, in terms of the crank angle of the crank member 34, the concave part 45 is formed over a range of 180° to 240° (over ±30° with reference to the TDC center position B serving as a center). Accordingly, as illustrated in FIG. 4, the first-stage and second-stage displacers 11 and 21 are stationary within the (crank angle) range of 180° to 240°. As a result, the first-stage and second-stage displacers 11 and 21 are stationary at a position of a displacement of 25.0 mm (top dead center) (see FIG. 4).

A description is given below of a more detailed movement of the roller bearing 35 at the time of engaging with the concave part 45. FIG. 5E illustrates a state where the roller bearing 35 has moved to a position corresponding to a crank angle of 180°. In this state, the roller bearing 35 is positioned at the boundary between the upper horizontal part 41 and the concave part 45.

When the crank member 34 rotates 30° from this state, the roller bearing 35 moves inside the slide groove 38 in the X1 direction.

Thus, the roller bearing 35 moves inside the slide groove 38 in the X1 direction while engaging with (contacting) the concave part 45, so that the roller bearing 35 enters the concave part 45.

The crank pin 34*a* to which the roller bearing 35 is attached is at a position eccentric to the center of the crank member 34. Therefore, when the roller bearing 35 is engaged with the upper horizontal part 41, the roller bearing 35 causes the Scotch yoke 36 to move in the Z1 direction. Therefore, with the movement of the Scotch yoke 36, the first-stage and second-stage displacers 11 and 21 move in the Z1 direction.

However, according to this embodiment, the concave part 45 is formed in the Scotch yoke 36, and the concave part 45 is depressed relative to the upper horizontal part 41.

Accordingly, even when the roller bearing 35 moves upward in the Z1 direction with the rotation of the crank member 34, the roller bearing 35 enters the concave part 45 to prevent the Scotch yoke 36 from moving in the Z1 direction, so that the Scotch yoke 36 becomes stationary. The concave part 45 has such a shape as to prevent the Scotch yoke 36 (the first-stage and second-stage displacers 11 and 21) from moving in the Z1 or Z2 direction while the roller bearing 35 is engaged (in contact) with the concave part 45.

Further, the concave part 45 is formed over ±30° with reference to the TDC center position B serving as a center. Accordingly, as illustrated in FIG. 4, the first-stage and second-stage displacers 11 and 21 are stationary within the range of 180° to 240° in terms of the crank angle of the crank member 34. As a result, the first-stage and second-stage displacers 11 and 21 are stationary at a position of a displacement of 25.0 mm (top dead center) within the range of 180° to 240° in terms of the crank angle of the crank member 34.

This stationary state is maintained from a crank angle of 180° illustrated in FIG. 5E to a crank angle of 240° illustrated in FIG. 5G via a crank angle of 210° illustrated in FIG. 5F.

When the roller bearing 35 passes by the position (region) corresponding to the top dead center of the first-stage and second-stage displacers 11 and 21 with the rotation of the crank member 34, the moving direction of the Scotch yoke 36 is reversed, so that the Scotch yoke 36 starts to move downward (in the Z2 direction). However, the Scotch yoke 36 (the first-stage and second-stage displacers 11 and 21) remains stationary before the roller bearing 35 becomes apart (disengaged) from the concave part 45.

Figure 5H:
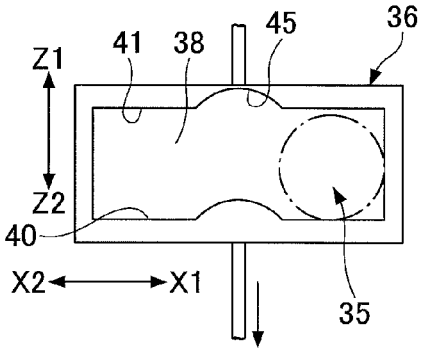

FIG. 5G illustrates a state immediately after the roller bearing 35 is disengaged from the concave part 45. The roller bearing 35 moves inside the slide groove 38 in the X1 direction from this position to engage with the lower horizontal part 40, so that the Scotch yoke 36 starts to move downward (in the Z2 direction). With this movement of the Scotch yoke 36, the first-stage and second-stage displacers 11 and 21 start to move downward (in the Z2 direction). FIG. 5H illustrates a state where the roller bearing 35 is engaged with the lower horizontal part 40.

Next, a description is given of effects produced by providing the concave part 45 in the Scotch yoke 36 (the slide groove 38).

In the GM refrigerator 1, the volumes of the first-stage and second-stage expansion chambers 15 and 25 are maximized at the top dead center. Further, the amount of a high-pressure refrigerant gas that fills in the first-stage and second-stage expansion chambers 15 and 25 is also maximized at the top dead center. Further, simultaneously with or slightly before the top dead center is reached, the exhaust valve 8 is opened to expand the refrigerant gas to produce cold temperatures. According to this embodiment, the exhaust valve 8 is opened at a crank angle of 170° before reaching the top dead center (crank angles of 180° to 240°). This opening of the exhaust valve 8 causes the refrigerant gas to expand, so that cold temperatures are produced.

Here, it is assumed that the first-stage and second-stage displacers 11 and 21 (the Scotch yoke 36) move fast around the top dead center. In this case, the cooled refrigerant gas is immediately discharged, thus reducing cooling efficiency.

In contrast, according to the GM refrigerator 1 of this embodiment, the first-stage and second-stage displacers 11 and 21 are stopped for a predetermined period of time at the top dead center (over 180° to 240° in terms of the crank angle of the crank member 34). Therefore, the refrigerant gas that has produced cold temperatures is temporarily retained in the first-stage and second-stage expansion chambers 15 and 25 so as to ensure heat exchange with a cooling stage 28 and a flange 18 (FIG. 1).

Further, with the expansion, the refrigerant gas that has produced cold temperatures flows into the regenerators 12 and 22. While the first-stage and second-stage displacers 11 and 21 are stationary, the refrigerant gas flows slow inside the regenerators 12 and 22. As a result, the refrigerant gas performs heat exchange with the regenerator materials 13 and 23 for a longer period of time to ensure the cooling of the regenerator materials 13 and 23.

Therefore, by providing the concave part 45 in the Scotch yoke 36 (the slide groove 38), it is possible to increase the cooling efficiency of the GM refrigerator 1.

Figures 6, 7:
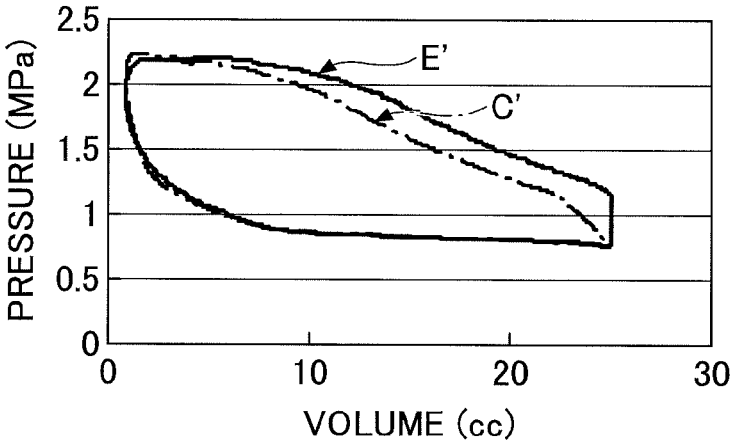
FIG. 6 illustrates a pressure-volume diagram of the GM refrigerator according to the embodiment of the present invention.
FIG. 7 illustrates effects according to the embodiment of the present invention.

FIG. 6 illustrates a pressure-volume (P-V) diagram of the GM refrigerator 1 according to this embodiment (the characteristics indicated by arrow E') and a P-V diagram of the conventional GM refrigerator without the concave part 45 in the Scotch yoke 36 (the slide groove 38) as a comparative example (the characteristics indicated by arrow C').

In the P-V diagram, the amount of cold generated during one cycle of a GM refrigerator corresponds to the area surrounded by the P-V diagram. Referring to FIG. 6, the area of the P-V diagram of the GM refrigerator 1 according to this embodiment is greater than the area of the P-V diagram of the conventional GM refrigerator according to the comparative example. Thus, FIG. 6 demonstrates that the GM refrigerator 1 according to this embodiment is higher in cooling efficiency than the GM refrigerator of the comparative example.

FIG. 7 illustrates the cooling temperature of the GM refrigerator 1 according to this embodiment and the cooling temperature of the conventional GM refrigerator according to the comparative example in a comparative manner. In each of the GM refrigerator 1 and the conventional GM refrigerator, a temperature near the first-stage expansion chamber and a temperature near the second-stage expansion chamber were measured.

As illustrated in FIG. 7, while the first-stage temperature of the GM refrigerator according to the comparative example was 46.2 K, the first-stage temperature of the GM refrigerator 1 according to this embodiment was 45.1 K. Further, while the second-stage temperature of the GM refrigerator according to the comparative example was 4.26

K, the second-stage temperature of the GM refrigerator 1 according to this embodiment was 4.19 K. Thus, FIG. 7 also demonstrates that the GM refrigerator 1 according to this embodiment is higher in cooling efficiency than the GM refrigerator of the comparative example.

According to this embodiment, the concave part 45 is provided in the Scotch yoke 36 of the Scotch yoke mechanism 32 in order to hold the first-stage and second-stage displacers 11 and 21 stationary as described above. The Scotch yoke mechanism is frequently used as a mechanism to convert the rotational motion of a motor into the linear reciprocating motion of a displacer in GM refrigerators. According to this embodiment, the Scotch yoke mechanism 32 is used as a mechanism to convert the rotational motion of the motor 30 into the linear reciprocating motion of the first-stage and second-stage displacers 11 and 21 in the GM refrigerator 1.

The first-stage and second-stage displacers 11 and 21 may be caused to reciprocate linearly by drivers other than the Scotch yoke mechanism 32, such as a stepper motor. However, other methods using a stepper motor or the like result in a complicate structure, make it difficult to perform control, and cause an increase in cost compared with the Scotch yoke mechanism 32. Therefore, it is preferable to use the Scotch yoke mechanism 32.

Further, according to this embodiment, the first-stage and second-stage displacers 11 and 21 are held stationary for a predetermined period of time by providing the concave part 45 in the Scotch yoke 36 in the Scotch yoke mechanism 32 that is thus inexpensive and simple in structure. Therefore, according to the GM refrigerator 1 of this embodiment, it is possible to implement a GM refrigerator of high cooling efficiency while simplifying a structure and reducing product costs.

According to this embodiment, while the roller bearing 35 is engaged with the concave part 45, the movement of the Scotch yoke 36 (the first-stage and second-stage displacers 11 and 21) is stopped. However, the movement of the Scotch yoke 36 may not be completely stopped, and the above-described effects may also be produced by making the moving speed lower than conventionally is.

Figure 8:
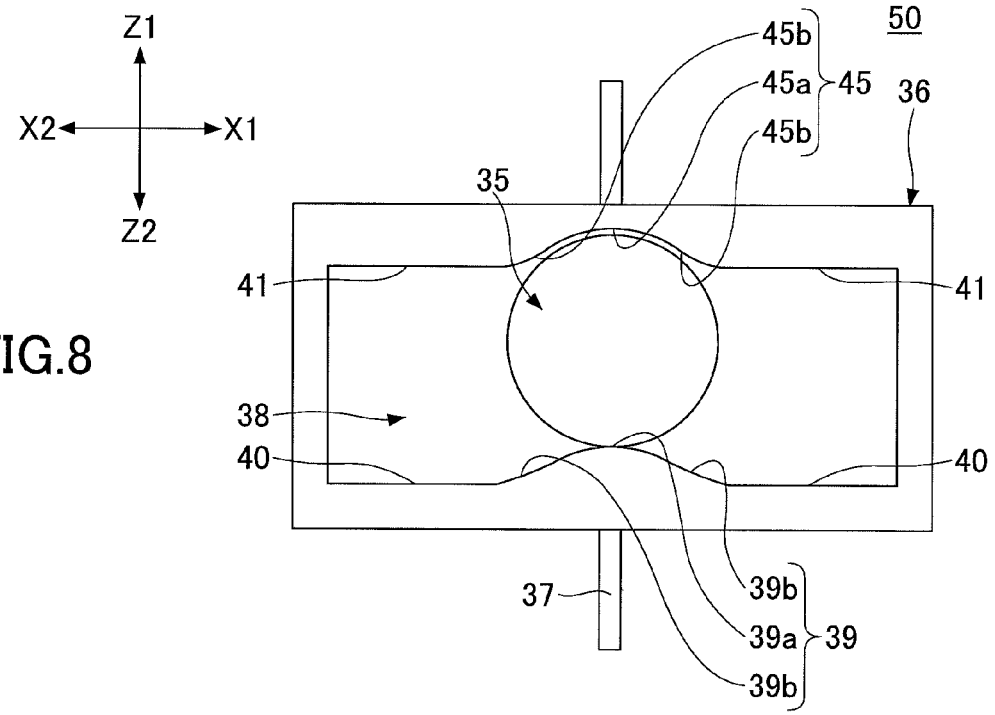
FIG. 8 is a diagram illustrating a first variation of the Scotch yoke mechanism according to the embodiment of the present invention.
Figure 9:
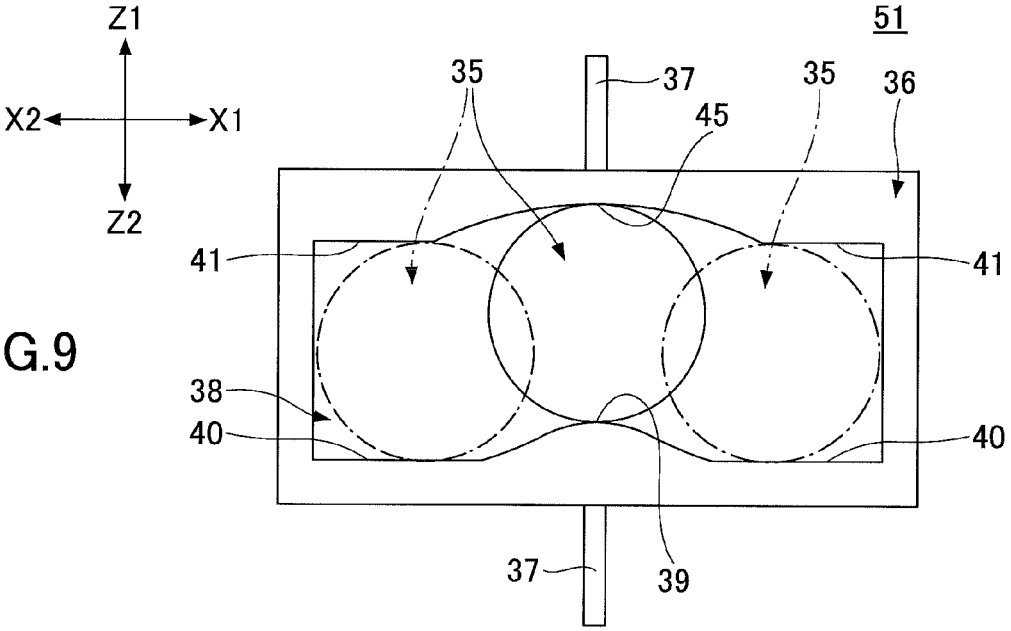
FIG. 9 is a diagram illustrating a second variation of the Scotch yoke mechanism according to the embodiment of the present invention.

FIG. 8 and FIG. 9 illustrate a first variation and a second variation, respectively, of the Scotch yoke mechanism 32 according to this embodiment. In FIG. 8 and FIG. 9, the same elements as those illustrated in FIG. 1 through FIG. 5H are referred to by the same reference numerals, and a description thereof is omitted.

In the embodiment illustrated using FIG. 1 through FIG. 5H, a description is given of the case where the concave part 45 of the Scotch yoke mechanism 32 has an arc shape. However, the concave part 45 is not limited to an arc shape, and may have any shape as long as the shape is depressed upward (in the Z1 direction) relative to the upper horizontal part 41. Likewise, the convex part 39 is not limited to an arc shape, and may have any shape as long as the shape is projecting upward (in the Z1 direction) relative to the lower horizontal part 40.

According to a Scotch yoke mechanism 50 of the first variation illustrated in FIG. 8, the convex part 39 includes an arc-shaped part 39*a* and flat parts 39*b*. The arc-shaped part 39*a* has an arc shape projecting upward, and is formed in the center of the convex part 39. Further, the flat parts 39*b* have respective flat surfaces, and are formed one between each end of the arc-shaped part 39*a* and the lower horizontal part 40. Accordingly, each flat part 39*b* defines an inclined surface.

Likewise, the concave part 45 includes an arc-shaped part 45*a* and flat parts 45*b*. The arc-shaped part 45*a* has an arc shape depressed upward, and is formed in the center of the concave part 45. Further, the flat parts 45*b* have respective flat surfaces, and are formed one between each end of the arc-shaped part 45*a* and the upper horizontal part 41. Accordingly, each flat part 45*b* defines an inclined surface.

According to this configuration, the flat parts 39*b* are formed between the arc-shaped part 39*a* and the lower horizontal part 40 and the flat parts 45*b* are formed between the arc-shaped part 45*a* and the upper horizontal part 41. Therefore, compared with the Scotch yoke mechanism 32 illustrated in FIG. 1 through FIG. 5H, it is possible to prevent generation of vibrations and noise.

The concave part 45 or the convex part 39 may not include an arc-shaped part, and, for example, may have a polygonal shape formed by combining multiple flat parts.

Further, in the embodiment illustrated in FIG. 1 through FIG. 5H, a configuration is illustrated where the roller bearing 35 comes into contact with one of the lower horizontal part 40 and the upper horizontal part 41 inside the slide groove 38. However, as in a Scotch yoke mechanism 51 of the second variation illustrated in FIG. 9, the roller bearing 35 may also be configured to constantly come into contact with the Scotch yoke 36 at two points inside the slide groove 38. This configuration may be achieved by suitably determining the shape of the slide groove 38 (for example, the shapes of the convex part 39, the concave part 45, the lower horizontal part 40, the upper horizontal part 41, etc.). According to this configuration, it is possible to prevent noise from being generated by movements between the roller bearing 35 and the slide groove 38, so that it is possible to provide the highly quiet GM refrigerator 1.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A cryogenic refrigerator, comprising:

a Scotch yoke mechanism including a crank member fixed to a motor shaft of a motor, the crank member including a crank pin provided at a position eccentric to a position at which the motor shaft is attached to the crank member;

a frame-shaped Scotch yoke defining a groove elongated in a first direction, the Scotch yoke including a first frame part and a second frame part that are elongated in the first direction and positioned across the groove from each other; and a bearing engaged with the crank pin and movably engaged with the groove of the Scotch yoke; and a displacer including a regenerator, the displacer being connected to the Scotch yoke so as to be caused to reciprocate in a cylinder with respect to a second direction perpendicular to the first direction by the Scotch yoke mechanism, so that a refrigerant gas inside an expansion space formed in the cylinder and connected to the regenerator is expanded by the reciprocation of the displacer to generate cold temperatures, wherein the first frame part is more distant from the expansion space than the second frame part, and the first frame part includes a concave part that is depressed in a direction away from the expansion space; and a first flat part extending between the concave part and a first end of the first frame part, and a second flat part extending between the concave part and a second end of the first frame part opposite to the first end thereof, the concave part including an arc-shaped portion in a center thereof;

a first flat potion extending between the arc-shaped portion and the first flat part, and inclined relative to the first flat part; and a second flat portion extending between the arc-shaped portion and the second flat part, and inclined relative to the second flat part.

2. The cryogenic refrigerator as claimed in claim 1, wherein the second frame part includes a convex part at a position corresponding to a position of the displacer at which the displacer is at a bottom of the cylinder.

3. The cryogenic refrigerator as claimed in claim 1, wherein the bearing is constantly in contact with the Scotch yoke at two points inside the groove.

4. The cryogenic refrigerator as claimed in claim 1, wherein the first frame part includes the concave part in a center of the first frame part.

5. The cryogenic refrigerator as claimed in claim 4, wherein the second frame part includes a convex part formed in a center of the second frame part.

6. The cryogenic refrigerator as claimed in claim 1, wherein the first frame part includes the concave part at a position corresponding to a position of the displacer at which the displacer maximizes a volume of the expansion space.

7. The cryogenic refrigerator as claimed in claim 2, wherein the second frame part includes the convex part at a position corresponding to a position of the displacer at which the displacer minimizes a volume of the expansion space.

8. The cryogenic refrigerator as claimed in claim 1, wherein the first frame part includes the concave part at a position corresponding to a position of the displacer at which the displacer is at a top of the cylinder.

9. The cryogenic refrigerator as claimed in claim 1, wherein the first frame part includes a first surface facing the groove and a second surface parallel to the first surface and facing away from the groove, and the first surface is depressed in the direction away from the expansion space to form the concave part with the second surface being flat.

10. The cryogenic refrigerator as claimed in claim 1, wherein the Scotch yoke further includes a third frame part extending in the second direction between the first end of the first frame part and a first end of the second frame part; and a fourth frame part extending in the second direction between the second end of the first frame part and a second end of the second frame part opposite to the first end thereof.

* * * * *